United States Patent [19]

Ruiz et al.

[11] Patent Number: 4,959,031

[45] Date of Patent: Sep. 25, 1990

[54] EASILY REMOVEABLE BATTERY TERMINAL

[76] Inventors: Arthur Ruiz, 1701 Newport Rd., Croydon, Pa. 19020; George Spector, 233 Broadway, New York, N.Y. 10007

[21] Appl. No.: 484,061

[22] Filed: Feb. 23, 1990

[51] Int. Cl.[5] ..... H01R 4/48; H01R 4/42

[52] U.S. Cl: ..... 439/759; 439/762; 439/765

[58] Field of Search ..... 439/754, 758, 759, 762, 439/765, 766, 771

[56] References Cited

U.S. PATENT DOCUMENTS

| | | | |
|---|---|---|---|
| 2,020,220 | 11/1935 | Smith | 439/759 |
| 2,068,544 | 1/1937 | Hahn | 439/759 |
| 2,602,105 | 7/1952 | Welch et al. | 439/759 |
| 3,008,114 | 11/1961 | Adkins | 439/759 |
| 3,407,383 | 10/1968 | Haegert | 439/763 |
| 3,409,865 | 11/1968 | Shannon | 439/760 |

FOREIGN PATENT DOCUMENTS 2513573 11/1975 Fed. Rep. of Germany ..... 439/762

*Primary Examiner*—Paula A. Bradley

[57] ABSTRACT

A battery terminal post clamp is provided and consists of a pair of inwardly curved arms having crossed end portions. The arms are pivotaly connected at their lower ends in a spaced apart relationship on one of two mounting plates. The mounting plates are attached together to fit and grip an electrical conductor of a battery cable. A finger engaging portion having an aperture therethrough is affixed to each crossed end portion of each arm so that a guide bolt can extend through each aperture with a guide nut threaded on the end of the shank. A coil compression spring is arranged on shank of the guide bolt between the finger engaging portions. The spring urges the finger engaging portions apart causing the arms to move towards each other to grip a terminal post until a person squeezes the finger engaging portions together to compress the spring and disengage the arms from the terminal post.

4 Claims, 1 Drawing Sheet

EASILY REMOVEABLE BATTERY TERMINAL

BACKGROUND OF THE INVENTION

The instant invention relates generally to battery clamps and more specifically it relates to a battery terminal post clamp which provides connection with the terminal post by spring pressure.

There are available various conventional battery clamps which do not provide the novel improvements of the invention herein disclosed.

SUMMARY OF THE INVENTION

A primary object of the present invention is to provide a battery terminal post clamp that will overcome the shortcomings of the prior art devices.

Another object is to provide a battery terminal post clamp that may be applied and removed from a terminal post of a battery without the use of special tools.

An additional object is to provide a battery terminal post clamp that will securely grip the terminal post of the battery by spring pressure thus preventing a loose connection thereto.

A further object is to provide a battery terminal post clamp that is simple and easy to use.

A still further object is to provide a battery terminal post clamp that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
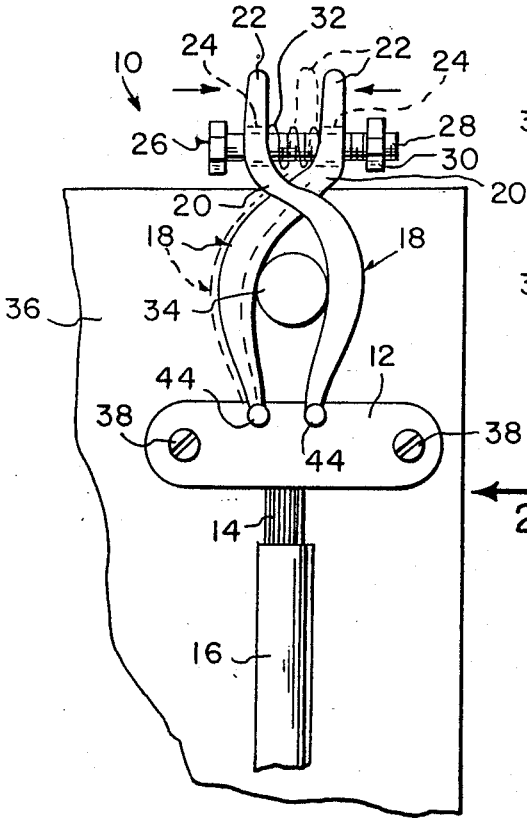
FIG. 1 is a top view of the invention attached to a battery terminal post.
Figure 2:
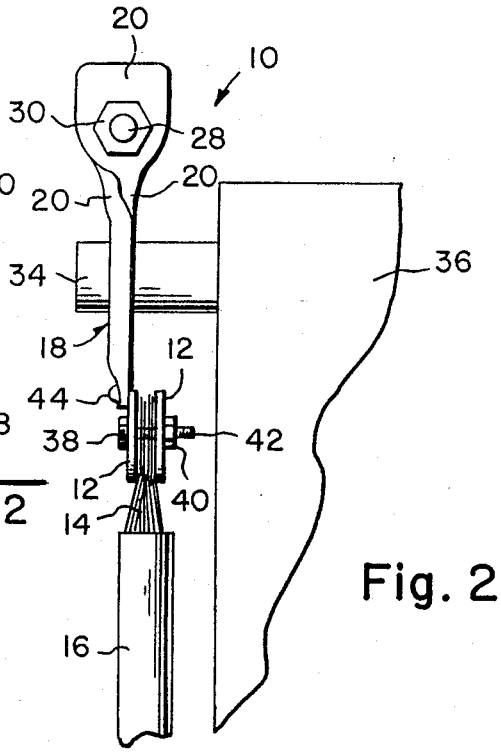
FIG. 2 is a side view taken in direction of arrow 2 in FIG. 1.

Turning now descriptively to the drawings, in which similar reference characters denote similar elements throughout the several views, FIGS. 1 and 2 illustrates a battery terminal post clamp 10 consisting of a pair of mounting plates 12 attached together so that an electrical conductor 14 of a battery cable 16 can fit and be gripped between the moving plates 12.

A pair of inwardly carried arms 18 are provided having crossed end portions 20. Each arm 18 is pivotly connected at its lower end on one mounting plate 12 in a spaced apart relationship to the other arm 18. A finger engaging portion 22 that has an aperture 24 therethrough is affixed to each crossed end portion 20 on each arm 18. A guide bolt 26 has a threaded shank 28 extending through each aperture 24 in each finger engaging portion 22 with a guide nut 30 threaded onto end of the shank 28.

A coil compression spring 32 is arranged on the shank 28 of the guide bolt 26 between the finger engaging portions 22. The spring 22 urges the finger engaging portions 22 apart causing the arms 18 to move towards each other to grip the terminal post 34 on a battery 36 until a person squeezes the finger engaging portions 22 together to compress the spring 32 and thereby disengage the arms 18 from the terminal post 34.

The mounting plates 12 are attached together by using a pair of mounting bolts 38 which are spaced apart and engageable to extend through the mounting plates 12. A mounting nut 40 is then threaded onto an end of a shank 42 of each of the mounting bolts 38. A pivot pin 44 is used to pivotly connect the lower end of each arm 18 to the mounting plate 12.

Figure 3:
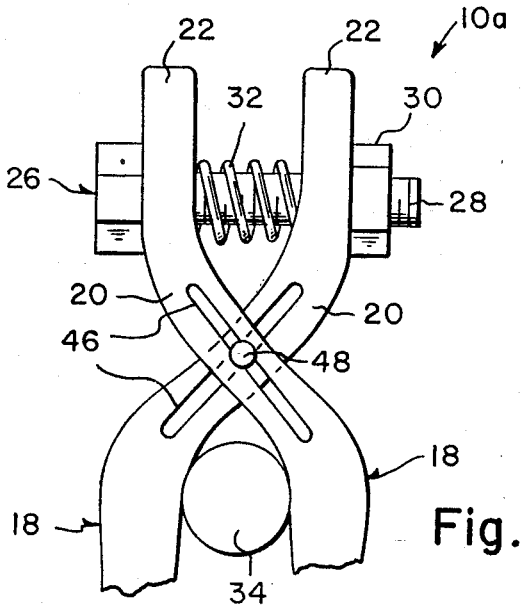
FIG. 3 is an enlarged top view of a portion of a modification in which the pin rides within slots in the arms to stabilize the clamp.

A modified clamp **10*a* is shown in FIG. 3 in which each arm 18 can have a slot 46 therein at its crossed end portion 20. A slide pin 48 rides within the slots 46 in the arms 18 to stabilize the clamp 10*a* when the arms 18 grip the terminal post 34 on the battery 36**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A battery terminal post clamp comprising:

(a) a pair of mounting plates;

(b) means for attaching said mounting plates together so that an electrical conductor of a battery cable can fit and be gripped between said mounting plates;

(c) a pair of inwardly curved arms having crossed end portions;

(d) means for pivotly connecting each said arm at its lower end on one said mounting plate in a spaced apart relationship to other said arm;

(e) a pair of finger engaging portions, each having an aperture therethrough and affixed to one said crossed end portion of one said arm;

(f) a guide bolt having a threaded shank extending through each aperture in each said finger engaging portion;

(g) a guide nut threaded onto end of said shank of said guide bolt for holding said guide bolt thereon; and (h) a coil compression spring arranged on said shank of said guide bolt between said finger engaging portions so as to urge said finger engaging portions apart causing said arms to move towards each other to grip a terminal post on a battery until a person squeezes said finger engaging portions together to compress said spring and thereby disengage said arms from the terminal post.

2. A battery terminal post clamp as recited in claim 1, wherein said attaching means includes:

(a) a pair of mounting bolts spaced apart and engageable to extend through said mounting plates; and (b) a pair of mounting nuts, each threaded onto an end of a shank of one of said mounting bolts.

3. A battery terminal post clamp as recited in claim 2, wherein said pivotly connecting means is a pivot pin.

4. A battery terminal post clamp as recited in claim 3, further includes:

(a) each said arm having a slot therein at its crossed end portion; and (b) a slide pin to ride within said slots in said arms to stabilize said clamp when said arms grip the terminal post on the battery.

* * * * *